US008230615B1

(12) United States Patent
Fletcher

(10) Patent No.: US 8,230,615 B1
(45) Date of Patent: Jul. 31, 2012

(54) HAIR DRYER DRAPE AND ASSOCIATED METHOD

(76) Inventor: Norma Fletcher, Greenbelt, MD (US)

( * ) Notice: Subject to any disclaimer, the term of this patent is extended or adjusted under 35 U.S.C. 154(b) by 916 days.

(21) Appl. No.: 12/150,786

(22) Filed: May 1, 2008

(51) Int. Cl.
*A45D 20/00* (2006.01)
*A45D 20/12* (2006.01)
*A45D 20/18* (2006.01)

(52) U.S. Cl. ..... 34/283; 34/96; 34/99

(58) Field of Classification Search ..... 34/283, 34/96, 97, 98, 99, 100, 101; 219/527, 211, 219/222; 2/174, 202, 204; 392/380, 381; 132/271, 274; D28/12, 16, 19
See application file for complete search history.

(56) References Cited

U.S. PATENT DOCUMENTS 1,646,193 A * 10/1927 Farkas ..... 2/207
2,504,394 A * 4/1950 Crafts ..... 34/99
2,663,090 A * 12/1953 Flaxman ..... 34/99
3,043,016 A * 7/1962 Miller ..... 34/99
D195,937 S * 8/1963 Victor ..... D28/19
3,108,862 A * 10/1963 Toulmin ..... 34/99
3,281,955 A * 11/1966 Clark, Jr. ..... 34/99
3,330,048 A * 7/1967 Rogers et al. ..... 34/99
D215,780 S * 10/1969 Berglass ..... D28/16
3,854,148 A * 12/1974 La Rose ..... 4/519
3,988,568 A * 10/1976 Mantell ..... 219/211
4,061,898 A * 12/1977 Murray et al. ..... 219/211
4,147,921 A * 4/1979 Walter et al. ..... 219/211
D257,291 S * 10/1980 Losenno ..... D28/19
4,289,150 A * 9/1981 Kimball ..... 132/270
4,862,602 A * 9/1989 Krill ..... 34/239
5,271,160 A 12/1993 Greiner
5,829,157 A * 11/1998 Gittens et al. ..... 34/99
5,887,357 A * 3/1999 McNair ..... 34/99
6,049,994 A 4/2000 Pickett
D469,217 S * 1/2003 Kimmons ..... D28/18
2004/0040087 A1 * 3/2004 Lack et al. ..... 5/413 AM
2005/0103279 A1 * 5/2005 Brewer et al. ..... 119/498
2008/0168675 A1 * 7/2008 Garman et al. ..... 34/195

* cited by examiner

*Primary Examiner* — Kenneth Rinehart
*Assistant Examiner* — Corey J Hall

(57) ABSTRACT

A combined hair dryer and hair dryer drape includes a hair dryer which has a semi-spherical dome provided with a cavity for receiving a user head therein during hair drying procedures. The hair dryer drape includes a plurality of sleeves contiguously and respectively formed along an entire perimeter of the hair dryer drape. The drape further includes a plurality of L-shaped spools situated at opposed corners of the hair dryer drape and partially extending along the corresponding sleeves. The drape further includes a plurality of hair dryer drape extensions wound about the corresponding spools and housed within the sleeves respectively. The hair dryer drape is made from water impermeable top and bottom layers pinched together along respective outer edges thereof and a plurality of insulating layers contiguously intercalated between the top and bottom layers for defining a core section.

4 Claims, 3 Drawing Sheets

FIG. 5
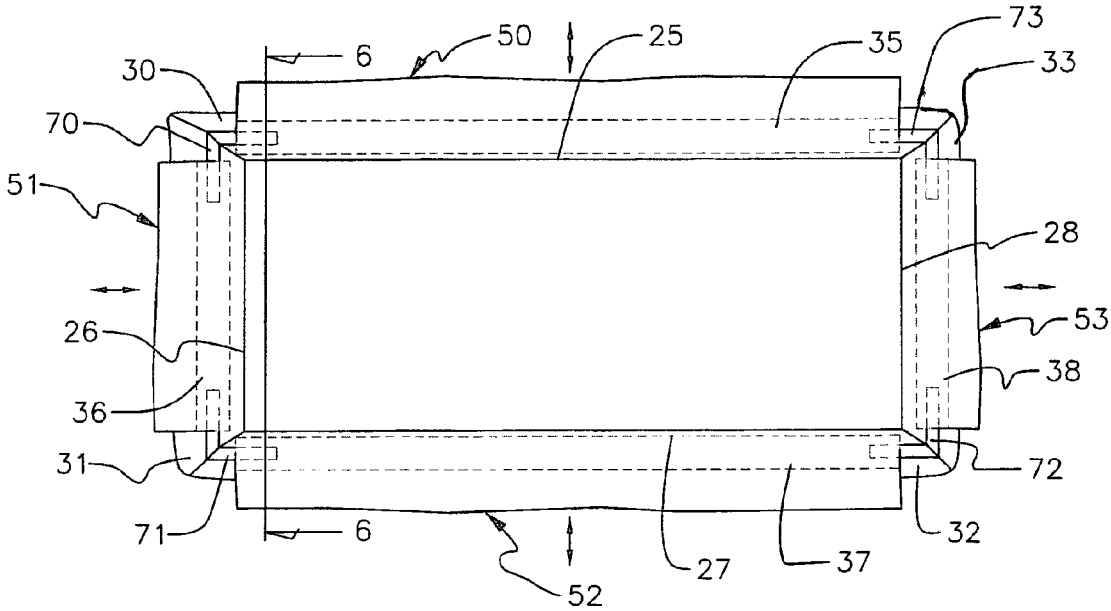
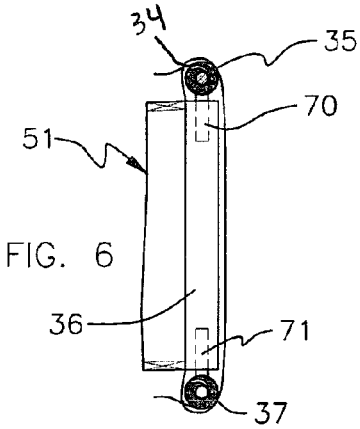
FIG. 6
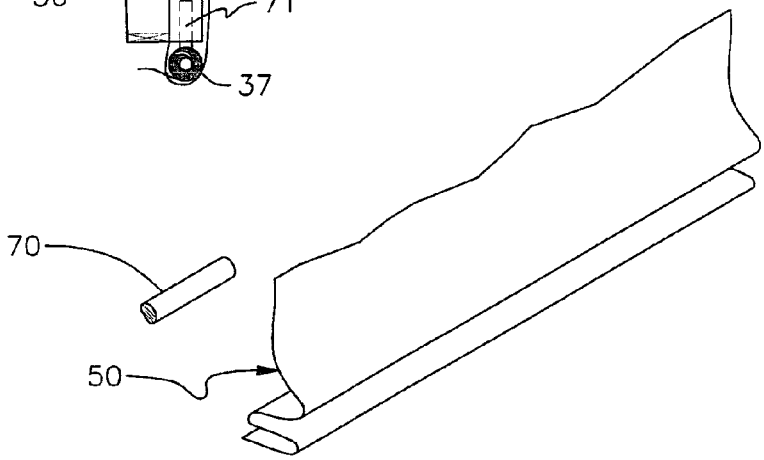
FIG. 7

HAIR DRYER DRAPE AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to methods and apparatuses for drying hair and, more particularly, to a combined hair dryer and drape to provide increased privacy and decreased drying time for a user.

2. Prior Art

Perhaps one of the most beneficial inventions of the modern era is the common hairdryer. Easily taken for granted by modern consumers, hairdryers provide a simple means in which women and men can quickly and efficiently dry their hair. In particular, this practical device found in most beauty salons and barber shops provides professional stylists an easy means of setting the permanent solutions, hair coloring, chemicals and curlers used on their client's hair. Most consumers wash their hair daily and this innovative styling tool is used both in professional salons and in the home to dry hair quickly and easily. Most hairdryers feature an adjustable hood which is designed to fit comfortably over a user head. The hood is configured with row after row of specially designed air vents which blow hot air onto a user head in order to dry the hair, activate a perm, or process chemicals. An unfortunate drawback to hairdryers is that a great deal of the warm air can easily escape the unit below the hood and the more hot air that escapes the hood, the longer the hair takes to dry. Additionally, running the hair dryer for several extra minutes results in an excessive waste of electricity, and thus a higher electric bill. Based on the above mentioned needs, it would be advantageous to provide a means for increasing privacy and decreasing drying time for a user.

U.S. Pat. No. 5,271,160 to Greiner discloses an attachment for a dome-shaped warm air hair dryer, especially for drying long hair. The attachment includes a circular manifold which receives air from the hair dryer. The manifold is coupled to a series of chambers which define a trailing drape. The chambers have orifices which divert warm air around the hair which is to be dried. A pad means is disposed around the perimeter of the drape to contain the hair and to permit drying air to flow therearound. Unfortunately, this prior art example does not provide for a drape to accompany the hair dryer that effectively prevents warm air from escaping the hood while redirecting air flow back onto the hair.

U.S. Pat. No. 5,651,190 to Sanders discloses a portable apparatus for drying the hair of a wearer. The hair dryer includes a support means such as a belt or shoulder strap for removably mounting the hair dryer apparatus on the body of the wearer. A casing having an opening is mounted on the support means. A blower is disposed within the casing and is operative to force air out of the casing through an opening. A conduit is coupled with the casing with an inlet of the conduit being in communication with the opening in the casing. The conduit is arranged and configured such that an outlet thereof may be positioned proximate to the hair of the wearer. The hair dryer may further include a cap member with a hole formed therein. The conduit is secured to the cap member such that the outlet is in communication with the hole. The hair dryer may be provided with a power source operative to provide electricity to the blower. Unfortunately, this prior art example is not designed to dry the hair more quickly and evenly by providing a hair dryer and hair dryer drape.

U.S. Pat. No. 6,049,994 to Pickett discloses a combination hair dryer cover and head shield which is for use with a hood-type hair dryer and is useful for energy conservation while also protecting the forehead, features and neck of the user from excess heat being emitting from the hair dryer. The apparatus comprises a hood cover and a head shield which are stitched together around the perimeter of a common seam. The apparatus will protect uncovered portions of the patrons' head from heat energy from the hair dryer. The shield cover and the hood cover are each made of a clear plastic material. The hood cover is secured onto the hood by an elastic band and the shield is retained onto the head of the patron by another elastic band. The apparatus is inexpensive to make and readily disposable, thereby providing improved sanitary conditions. Unfortunately, this prior art example does not cut down on the length of time it takes to dry the user's hair.

Accordingly, a need remains for a combined hair dryer and insulated hair dryer drape in order to overcome the above-noted shortcomings. The present invention satisfies such a need by providing an apparatus that is convenient and easy to use, is lightweight yet durable in design, and increases privacy and decreases drying time for a user. The apparatus is simple to use, inexpensive, and designed for many years of repeated use.

BRIEF SUMMARY OF THE INVENTION

In view of the foregoing background, it is therefore an object of the present invention to provide an apparatus that provides increased privacy and decreased drying time for a user. These and other objects, features, and advantages of the invention are provided by a combined hair dryer and hair dryer drape.

In a preferred embodiment a combined hair dryer and hair dryer drape includes a hair dryer which has a semi-spherical dome provided with a cavity for receiving a user head therein during hair drying procedures. The hair dryer drape is conveniently positioned over the hair dryer. Such a hair dryer drape has first, second, third and fourth edges arranged in such a manner that the hair dryer covers an entire outer surface of the dome, the body is formed from heat-insulating material for preventing undesirable heat dissipation away from the dome during hair drying procedures.

The hair dryer drape effectively includes a plurality of sleeves contiguously and respectively formed along the first, second, third and fourth edges of the hair dryer drape such that opposed ends of the sleeves are directly abutted at an end-to-end relationship and travel along an entire perimeter of the hair dryer drape respectively. Such sleeves include; first, second, third and fourth sleeves conjoined to the first, second, third and fourth edges of the hair dryer drape respectively. Each of the first, second, third and fourth sleeves has a longitudinal slit formed therealong and define an ingress and egress path through which the first, second, third and fourth rolls are selectively adapted between wound and unwound positions respectively.

The apparatus further includes a plurality of L-shaped spools effectively situated at opposed corners of the hair dryer drape and partially extending along the corresponding sleeves. Each of the spools and the rolls are removably interfitted within the corresponding sleeves for allowing a user to remove the spools and the rolls during cleaning procedures.

The apparatus further includes a plurality of hair dryer drape extensions wound about the corresponding spools and housed within the sleeves respectively. Such hair dryer drape extensions are selectively and independently extractable from the respective sleeves in such a manner that the hair dryer drape extensions conveniently travel along mutually exclusive paths defined adjacent to the first, second, third and fourth edges of the hair dryer drape respectively. The hair dryer drape extensions include first, second, third and fourth rolls journaled about the corresponding spools in such a manner that the first, second, third and fourth rolls lay parallel to the first, second, third and fourth edges of the hair dryer drape respectively.

The hair dryer drape further includes water impermeable top and bottom layers pinched together along respective outer edges thereof and a plurality of insulating layers contiguously intercalated between the top and bottom layers for defining a core section. The insulating layers are directly conjoining to each other and arranged in a stacked orientation.

A method for assisting a user to efficiently dry their hair includes the steps of: providing a free-standing hair dryer including a semi-spherical dome which has a cavity; the user positioning the user head within the dome during hair drying procedures; providing and removably positioning a flexible and non-resilient hair dryer drape over the hair dryer, the hair dryer drape is formed from heat-insulating material and has first, second, third and fourth edges arranged in such a manner that the hair dryer covers an entire outer surface of the dome; and preventing undesirable heat from dissipating away from the dome during hair drying procedures.

The method further includes the steps of: providing and contiguously forming a plurality of sleeves along the first, second, third and fourth edges respectively such that opposed ends of the sleeves are directly abutted at an end-to-end relationship and travel along an entire perimeter of the hair dryer drape respectively; providing and situating a plurality of L-shaped spools at opposed corners of the hair dryer drape by partially extending the spools along the corresponding sleeves; providing and housing a plurality of hair dryer drape extensions within the sleeves respectively by winding the hair dryer drape extensions about the corresponding spools respectively; and selectively and independently extracting the hair dryer drape extensions from the respective sleeves by displacing the hair dryer drape extensions along mutually exclusive paths defined adjacent to the first, second, third and fourth edges of the hair dryer drape respectively.

The method further includes the step of: providing and journaling first, second, third and fourth rolls about the corresponding spools; and laying the first, second, third and fourth rolls parallel to the first, second, third and fourth edges of the hair dryer drape respectively.

The method further includes the steps of: providing and conjoining first, second, third and fourth sleeves to the first, second, third and fourth edges of the hair dryer drape respectively; and selectively winding and unwinding the first, second, third and fourth rolls through longitudinal slits respectively formed within the first, second, third and fourth sleeves.

The method further includes the steps of: removing the spools and the rolls from the corresponding sleeves; and cleaning the spools and the rolls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 5 is a top plan view showing the extensions removably housed within the sleeves of the drape, in accordance with another embodiment of the present invention;

FIG. 6 is a cross-sectional view taken along line 6-6, as seen in FIG. 5 showing the slit in a corresponding sleeve; and FIG. 7 is a partially exploded view showing an extension completely unwound from a corresponding spool after being removed from the corresponding sleeve.

DETAILED DESCRIPTION OF THE INVENTION

Figure 1:
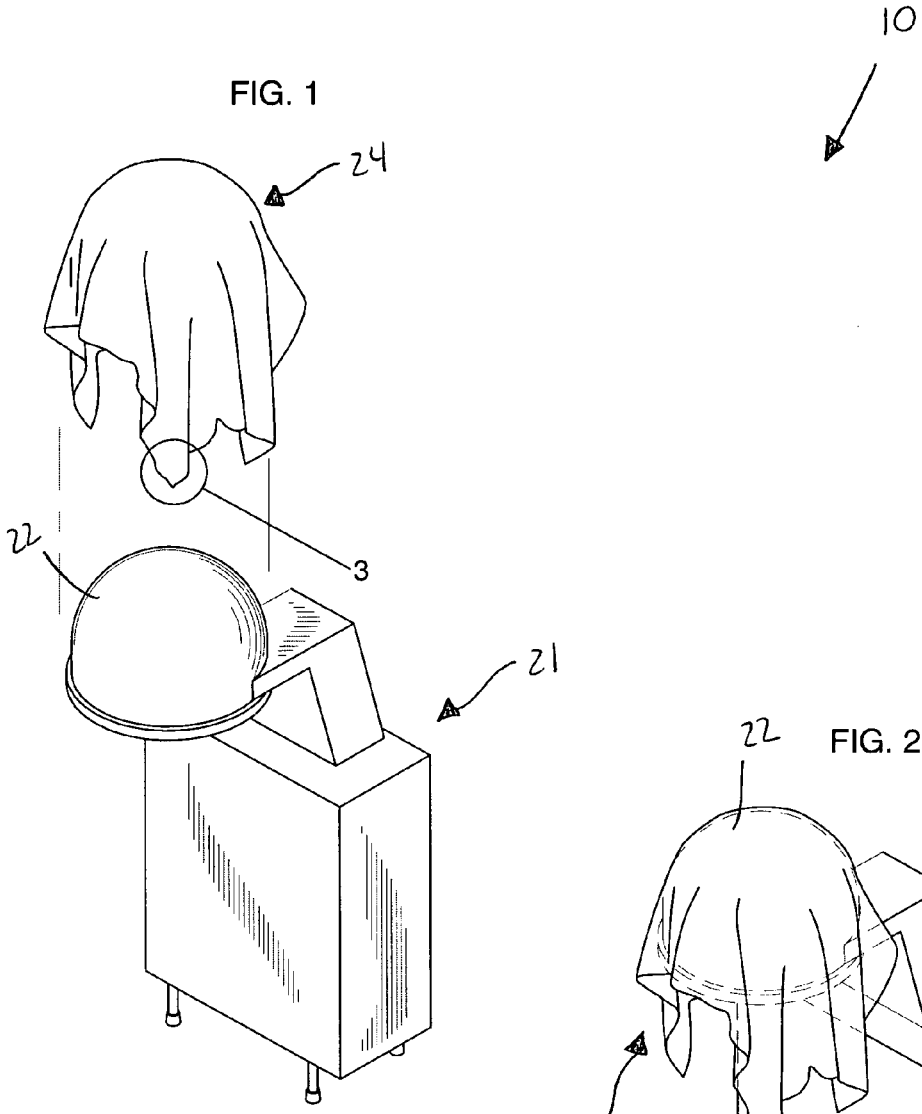
FIG. 1 is a perspective view showing a drape separated from a dryer, in accordance with one embodiment of the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus 10 of this invention is referred to generally in FIGS. 1-7 by the reference numeral 10 and is intended to provide a combined hair dryer and hair dryer drape. It should be understood that the apparatus 10 may be used to cover many different types of objects and should not be limited in use to covering only those objects described herein.

Figure 2:
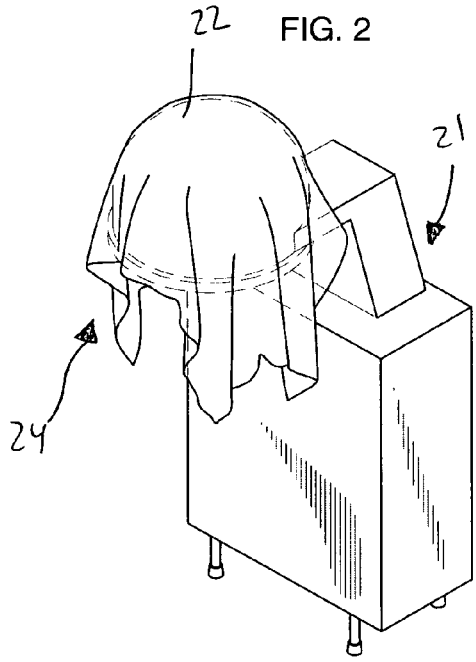
FIG. 2 is a perspective view showing the drape positioned on the dome of the dryer.

Referring initially to FIGS. 1 and 2 combined hair dryer and hair dryer drape includes a hair dryer 21 which has a semi-spherical dome 22 provided with a cavity for receiving a user head therein during hair drying procedures. The hair dryer drape 24 is positioned over the hair dryer 21. Such a hair dryer drape 24 has first, second, third and fourth edges 25, 26, 27, 28 arranged in such a manner that the hair dryer drape 24 covers an entire outer surface of the dome 22, the body is formed from heat-insulating material for preventing undesirable heat dissipation away from the dome 22 during hair drying procedures. The combination of such claimed elements is not rendered obvious by one skilled in the art because it provides a dryer drape 24 that has the unpredictable and unexpected benefit of preventing warm air from escaping out of the hair dryer dome 22 while also providing privacy to the user. This process overcomes the shortcomings associated with ordinary hair dryers that allow heat to dissipate out of the hair dryer dome 22 which makes drying time longer and creates a higher associated monetary expense.

Referring to FIGS. 5, 6, and 7 the hair dryer drape 24 further includes a plurality of sleeves 30, 31, 32, 33 contiguously and respectively formed along the first, second, third and fourth edges 25, 26, 27, 28 of the hair dryer drape, such that opposed ends of the sleeves 30, 31, 32, 33 are directly, without the use of intervening elements, abutted at an end-to-end relationship and travel along an entire perimeter of the hair dryer drape 24 respectively. Such sleeves 30, 31, 32, 33 include; first, second, third and fourth sleeves 30, 31, 32, 33 conjoined to the first, second, third and fourth edges 25, 26, 27, 28 of the hair dryer drape 24 respectively. Each of the first, second, third and fourth sleeves 30, 31, 32, 33 has a longitudinal slit 34 formed therealong and defines an ingress and egress path through which the first, second, third and fourth rolls 35, 36, 37, 38 are selectively adapted between wound and unwound positions respectively.

The apparatus 10 further includes a plurality of L-shaped spools 70, 71, 72, 73 situated at opposed corners of the hair dryer drape 24 and partially extending along the corresponding sleeves 30, 31, 32, 33. Each of the spools 70, 71, 72, 73 and the rolls 35, 36, 37, 38 are removably interfitted within the corresponding sleeves 30, 31, 32, 33 for allowing a user to remove the spools 70, 71, 72, 73 and the rolls 35, 36, 37, 38 during cleaning procedures. The combination of such claimed elements is not rendered obvious by one skilled in the art because it provides for spools 70, 71, 72, 73 that have the unpredictable and unexpected result of being removably interfitted within the sleeves 30, 31, 32, 33. Such a combination overcomes the shortcomings associated with a generic cover because a generic cover would not be designed to fit perfectly over a hair dryer 21 and user. Further, a generic cover would not be designed to effectively remove parts for convenient clean up.

The apparatus further includes a plurality of hair dryer drape extensions 50, 51, 52, 53 wound about the corresponding spools 70, 71, 72, 73 and housed within the sleeves 30, 31, 32, 33 respectively. Such hair dryer drape extensions 50, 51, 52, 53 are selectively and independently extractable from the respective sleeves 30, 31, 32, 33 in such a manner that the hair dryer drape extensions 50, 51, 52, 53 travel along mutually exclusive paths defined adjacent to the first, second, third and fourth edges 25, 26, 27, 28 of the hair dryer drape 24 respectively. The hair dryer drape extensions 50, 51, 52, 53 include first, second, third and fourth rolls 35, 36, 37, 38 journaled about the corresponding spools 70, 71, 72, 73 in such a manner that the first, second, third and fourth rolls 35, 36, 37, 38 lay parallel to the first, second, third and fourth edges 25, 26, 27, 28 of the hair dryer drape 24 respectively. Such a combination of claimed elements allows a user to shorten or extend the dryer drape 24 such that the drape 24 effectively covers all of the necessary portions of the user's hair, for example.

Figure 3:
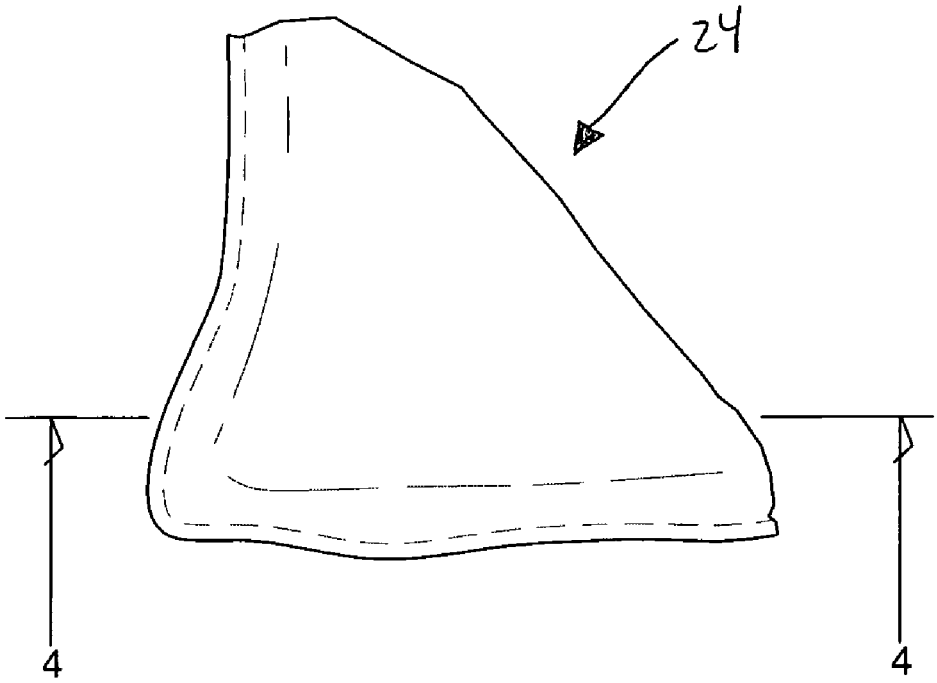
FIG. 3 is an enlarged view showing a partial corner of the drape.
Figure 4:
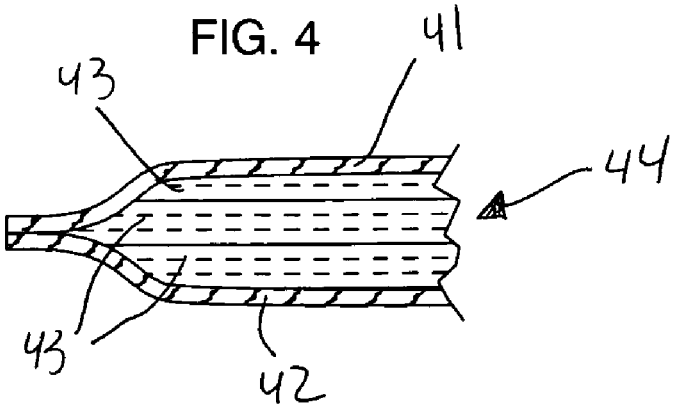
FIG. 4 is a cross-sectional view of the drape taken along line 4-4 of FIG. 3.

Referring to FIGS. 3 and 4 the hair dryer drape 24 further includes water impermeable top and bottom layers 41, 42 pinched together along respective outer edges thereof and a plurality of insulating layers 43 contiguously intercalated between the top and bottom layers 41, 42 for defining a core section 44. The insulating layers 43 are directly, without the use of intervening elements, conjoined to each other and arranged in a stacked orientation. The combination of such claimed elements is not rendered obvious by one skilled in the art because the core section provides for the unpredictable and unexpected result of water impermeable top and bottom layers 41, 42. Such layers 41, 42 effectively prolong the life of the drape 24 by preventing water and like substances, for example, from penetrating the core section 44, while still providing maximum insulation for one of the drape's 24 intended uses of preventing heat from dissipating out from under the hair dryer dome 22.

The apparatus 10 may, in one embodiment, include a drape 24 configured to fit over the top of a stationary dryer hood 22, which is essential for advantageously preventing air from escaping the dryer 21, thereby reducing the time necessary to thoroughly dry the hair. If desired, particular embodiments may include dryer drapes that are primarily manufactured of heat resistant, thermal fabric material. The present invention 10, may in one embodiment, be a rectangular shaped unit measuring an ample thirty-six and one half inches in length and forty-four and one quarter inches in width, as an example. Of course, such a drape 24 can be formed from a variety of heat resistant materials and produced in a variety of shapes and sizes, as is obvious to a person of ordinary skill in the art. Such a drape 24 can be produced in a variety of fancy colors and printed designs, as well as in neutral hues of black, beige or white, as is obvious to a person of ordinary skill in the art. Additionally, salon operators can order customized versions of the apparatus 10 emblazoned with the name or logo of their establishment.

In use, the insulated hair dryer cover 24 is simple and straightforward to use. The invention may be used to a particular advantage by first, allowing the user to position the hair dryer dome 22 over their head per their normal routine, setting the operational controls to the desired heat and power setting. The user may then simply drape the apparatus 10 directly over the dome 22 of the dryer 21, without the use of intervening elements, so that the sides of the drape 24 hang freely about the sides of the dome 22, which is critical for encompassing the open area between the base of the dome 22 and the user neck and shoulders. Thus installed, the apparatus 10 advantageously prevents air from escaping the dome 22 at the bottom of the dryer 21, which is crucial for redirecting this flow of air to the user head. The user may then dry or process their hair as usual, periodically checking their locks to make sure they are drying or processing properly. After use, the hair dryer 21 may be turned off and the user may emerge from the dryer dome 22, styling their hair as usual.

The present invention, as claimed, provides the unexpected and unpredictable benefit of an apparatus 10 that is convenient and easy to use, is lightweight yet durable in design, and increases privacy and decreases drying time for a user. The apparatus provides consumers with a simple and efficient means of drying their hair via a stationary hair dryer 21. A lightweight drape 24 which effectively encompasses the dryer dome 22 and hangs several inches below, the apparatus 10 prevents warm air from escaping the dome 22, while redirecting this air flow back onto the hair. Such a drape 24 dramatically reduces the amount of warm air lost when drying the hair. The apparatus 10 enables consumers to advantageously dry or process their hair in a more expeditious manner. The apparatus 10 ensures that hair is dried or processed, evenly and quickly, thus advantageously sparing the user the hassle of long waits beneath the dryer dome 22. Salon owners and operators appreciate that a client's hair is dried much quicker with the apparatus 10, and less electricity is used, thus resulting in a lower electric bill and associated monetary savings.

In use, a method for assisting a user to efficiently dry their hair includes the steps of: providing a free-standing hair dryer 21 including a semi-spherical dome 22 which has a cavity; the user positioning the user head within the dome 22 during hair drying procedures; providing and removably positioning a flexible and non-resilient hair dryer drape 24 over the hair dryer 21, the hair dryer drape 24 is formed from heat-insulating material and has first, second, third and fourth edges 25, 26, 27, 28 arranged in such a manner that the hair dryer drape 24 covers an entire outer surface of the dome 22; and preventing undesirable heat from dissipating away from the dome 22 during hair drying procedures.

In use, the method may further include the steps of: providing and contiguously forming a plurality of sleeves 30, 31, 32, 33 along the first, second, third and fourth edges 25, 26, 27, 28 respectively such that opposed ends of the sleeves 30, 31, 32, 33 are directly abutted at an end-to-end relationship and travel along an entire perimeter of the hair dryer drape 24 respectively; providing and situating a plurality of L-shaped spools 70, 71, 72, 73 at opposed corners of the hair dryer drape 24 by partially extending the spools 70, 71, 72, 73 along the corresponding sleeves 30, 31, 32, 33; providing and housing a plurality of hair dryer drape extensions 50, 51, 52, 53 within the sleeves 30, 31, 32, 33 respectively by winding the hair dryer drape extensions 50, 51, 52, 53 about the corresponding spools 70, 71, 72, 73 respectively; and selectively and independently extracting the hair dryer drape extensions 50, 51, 52, 53 from the respective sleeves 30, 31, 32, 33 by displacing the hair dryer drape extensions 50, 51, 52, 53 along mutually exclusive paths defined adjacent to the first, second, third and fourth edges 25, 26, 27, 28 of the hair dryer drape 24 respectively.

In use, the method may further include the steps of: providing and journaling first, second, third and fourth rolls 35, 36, 37, 38 about the corresponding spools 70, 71, 72, 73; and laying the first, second, third and fourth rolls 35, 36, 37, 38 parallel to the first, second, third and fourth edges 25, 26, 27, 28 of the hair dryer drape 24 respectively.

In use, the method may further include the steps of: providing and conjoining first, second, third and fourth sleeves 30, 31, 32, 33 to the first, second, third and fourth edges 25, 26, 27, 28 of the hair dryer drape 24 respectively; and selectively winding and unwinding the first, second, third and fourth rolls 35, 36, 37, 38 through longitudinal slits 34 respectively formed within the first, second, third and fourth sleeves 30, 31, 32, 33. Thus, a user can adjust the dimensions of the drape to fit their particular needs.

In use, the method may further include the steps of: removing the spools 70, 71, 72, 73 and the rolls 35, 36, 37, 38 from the corresponding sleeves 30, 31, 32, 33; and cleaning the spools 70, 71, 72, 73 and the rolls 35, 36, 37, 38.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined hair dryer and hair dryer drape for assisting a user to efficiently dry their hair, said combined hair dryer and hair dryer drape comprising:

a hair dryer having a semi-spherical dome provided with a cavity for receiving a user head therein during hair drying procedures; and a hair dryer drape positioned over said hair dryer, said hair dryer drape having first, second, third and fourth edges;

wherein said hair dryer drape further comprises:

a plurality of sleeves contiguously and respectively formed along said first, second, third and fourth edges such that opposed ends of said sleeves are directly abutted at an end-to-end relationship and travel along an entire perimeter of said hair dryer drape respectively;

a plurality of L-shaped spools situated at opposed corners of said hair dryer drape and partially extending along corresponding ones of said sleeves;

a plurality of hair dryer drape extensions wound about corresponding ones of said spools and housed within said sleeves respectively;

wherein each of said hair dryer drape extensions are selectively and independently extractable from said respective sleeves in such a manner that said hair dryer drape extensions travel along mutually exclusive paths defined adjacent to said first, second, third and fourth edges of said hair dryer drape respectively;

wherein said hair dryer drape extensions comprise: first, second, third and fourth rolls journaled about said corresponding spools in such a manner that said first, second, third and fourth rolls lay parallel to said first, second, third and fourth edges of said hair dryer drape respectively.

2. The combined hair dryer and hair dryer drape of claim 1, wherein said sleeves comprise: first, second, third and fourth sleeves conjoined to said first, second, third and fourth edges of said hair dryer drape respectively, each of said first, second, third and fourth sleeves having a longitudinal slit formed therealong and defining an ingress and egress path through which said first, second, third and fourth rolls are selectively adapted between wound and unwound positions respectively.

3. The combined hair dryer and hair dryer drape of claim 2, wherein each of said spools and said rolls are removably interfitted within said corresponding sleeves for allowing a user to remove said spools and said rolls during cleaning procedures.

4. The combined hair dryer and hair dryer drape of claim 1, wherein said hair dryer drape comprises:

water impermeable top and bottom layers pinched together along respective outer edges thereof; and a plurality of insulating layers contiguously intercalated between said top and bottom layers for defining a core section, said insulating layers being directly conjoining to each other and arranged in a stacked orientation.

* * * * *